US007201541B2

(12) United States Patent
Barmann

(10) Patent No.: US 7,201,541 B2
(45) Date of Patent: Apr. 10, 2007

(54) PROP HEAD BEARING

(75) Inventor: Rudolf Barmann, Wuppertal (DE)

(73) Assignee: DBT GmbH, Lunen (DE)

( * ) Notice: Subject to any disclaimer, the term of this patent is extended or adjusted under 35 U.S.C. 154(b) by 110 days.

(21) Appl. No.: 11/192,906

(22) Filed: Jul. 29, 2005

(65) Prior Publication Data

US 2006/0024138 A1 Feb. 2, 2006

(51) Int. Cl.
*E21D 15/55* (2006.01)

(52) U.S. Cl. ..... 405/296; 405/290; 405/291; 405/288; 299/33; 248/288.51

(58) Field of Classification Search ..... 405/288, 405/290, 291, 293, 294, 296; 299/33, 11; 248/181.2, 288.51, 181.1, 288.31
See application file for complete search history.

(56) References Cited

U.S. PATENT DOCUMENTS

| | | | | |
|---|---|---|---|---|
| 2,474,464 | A * | 6/1949 | Cable | 254/93 R |
| 3,425,656 | A * | 2/1969 | Bore | 248/357 |
| 4,004,771 | A * | 1/1977 | Plevak et al. | 248/357 |
| 4,457,212 | A * | 7/1984 | Unger et al. | 92/18 |

FOREIGN PATENT DOCUMENTS

| | | | |
|---|---|---|---|
| DE | 36 40 008 | A1 | 5/1988 |
| DE | 42 14 690 | A1 | 11/1993 |
| DE | 20 2004 015 149 | U1 | 12/2004 |
| GB | 1104428 | A | 3/1965 |

OTHER PUBLICATIONS

Search Report dated Sep. 1, 2005 from the British Patent Office.

* cited by examiner

*Primary Examiner*—Frederick L. Lagman
(74) *Attorney, Agent, or Firm*—Cook, Alex, McFarron, Manzo, Cummings & Mehler, Ltd.

(57) ABSTRACT

A prop head bearing between the roof bar and the prop (4) of a shield-type support frame, comprising a ball-joint socket (3) on the roof bar and open towards the prop for receiving a ball-joint head (2) on the prop (4), with at least one movable securing element (6, 7) which, when in a secured position, engages in a recess (12, 13) in the joint head (2) to prevent accidental lifting of the joint head (2) out of the socket (3), and with a bolt which locks the securing element (6, 7) in the secured position, in which that the securing element is in the form of a securing pin (6, 7) movable along its longitudinal axis between the secured position and an assembly position, wherein the securing pin (6, 7) is lockable by the bolt (14, 19) in the assembly position, in which it does not engage in the recess (12, 13) in the joint head (2).

14 Claims, 3 Drawing Sheets

PROP HEAD BEARING

The present invention relates to a prop head bearing between the roof bar and prop of a shield-type support frame for underground use, comprising a ball-joint socket on the roof bar and open towards the prop for receiving a ball-joint head on the prop, with at least one movable securing element which, when in a secured position, engages in a recess in the joint head to prevent accidental lifting of the joint head out of the socket, and with a bolt which locks the securing element in the secured position.

In mining it is conventional to use a ball joint to connect the prop and the roof bar of a shield-type support frame. As known for example from DE 22 44 312, the articulated connection comprises a ball-joint socket, disposed on the roof bar and open towards the prop, for a ball-joint head of the prop and at least one movable securing element which when in a secured position engages in a recess in the joint head to prevent accidental lifting of the joint head out of the socket. The securing element is locked in the secured position by a bolt or the like. To separate the joint head from the socket, the securing element is opened and placed on one side so that it no longer engages in the recess in the joint head, which can then be taken out of the socket. The securing element may become lost in the process.

In shield-type support frames produced at present by the assignees, use is made of a prop-head receiver which forms the socket, wherein the securing element is mounted so as to be pivotable around a swivel axis. A movable locking bolt, releasably connected to the prop-head recess, extends parallel to and at a distance from the swivel axis. When in the secured position, the side of the securing element remote from the joint head of the prop abuts the locking bolt, so that the securing element cannot accidentally be twisted out of the secured position. In order to undo the connection between the socket and the joint head, therefore, the locking bolt must be pushed out of the bearing in the prop-head holder provided for it, so that the securing element no longer abuts the locking bolt and can be twisted or unscrewed out of the recess in the joint head. Admittedly in this case there is no risk of losing the securing pin when the articulated connection is undone, since the pin continues to be connected to the prop-head receiver via the rotary bearing. It may happen, however, that the now freely-pivotable securing element will prevent the joint head from being released from or inserted into the socket. The prop-head receiver is also comparatively complicated in construction.

An aim of the invention is to provide a prop-head bearing or articulated connection between the roof bar and the prop, wherein the construction is simple and it is easier to separate or fit together the socket and the joint head.

Accordingly the present invention is directed to a prop head bearing as described in the opening paragraph of the present specification wherein, the securing element is in the form of a securing pin movable along its longitudinal axis between the secured position and an assembly position, wherein the securing pin is also lockable by the bolt in the assembly position, in which it does not engage in the recess in the joint head. As a result of this feature the securing pin is locked and non-losable, both in the secured position in which it engages in the recess in the joint head and in the assembly position in which the articulated connection can be broken. Locking in the assembly position also prevents uncontrolled movement of the securing pin when the joint head and socket are fitted together.

Preferably the securing pin has two axially spaced-apart contact surfaces for the bolt. One surface is operatively connected to the bolt when the securing pin is in the secured position, whereas the other surface co-operates with the bolt when the securing pin is in the assembly position. In order to move the securing pin from one to the other position, it must be axially shifted by a distance equal to the spacing between the contact surfaces.

Preferably the contact surfaces for the locking bolt are disposed near an end of the securing pin remote from the joint head.

In a preferred embodiment the bolt locks the securing pin positively in both axial directions of motion of the securing pin. This applies both to the secured position and to the assembly position. The position of the securing pin is thus determined, since it is movable only between these two positions along its longitudinal axis.

Preferably the securing pin, at an end remote from the joint head, has at least two grooves on the periphery, extending in the peripheral direction. The inner walls of a groove constitute the contact surface or surfaces for the bolt, which extends in the groove transversely of the longitudinal axis of the securing pin. The bolt, like the securing pin, can be mounted for axial movement on one or more radial ball bearings. When placed or pushed into the groove, therefore, the bolt prevents axial movement of the securing pin.

The cross-section of the grooves can be semicircular.

Preferably a bolt in the form of a round cross-section locking bolt can be inserted into the semicircular groove. The diameter of the locking bolt is approximately equal to the diameter of the semicircular groove cross-section, so that the grooves and locking bolt abut one another slightly and with an exact fit.

In a preferred example embodiment the recess in the joint head, in which the securing pin engages when in the secured position, is a blind bore. The joint head is weakened by a blind bore less than by a through bore.

Preferably the socket is formed in the prop-head receiver which comprises a bearing for the movable securing pin and a bolt bearing for the bolt.

Preferably the prop-head receiver is in one piece, so that the socket, the bearing for the movable securing pin and the bolt bearing for the bolt form a unit.

Advantageously the prop-head receiver is in the form of a casting.

In a preferred example embodiment the socket is disposed between two opposite bearing blocks with bearings for respective securing pins, wherein the securing pins lie along the same axis. This axis advantageously corresponds with a swivel axis around which the joint head of the prop rotates in the socket when the shield-type support frame is in use.

Each bearing for the securing pin is preferably associated with a bolt bearing. Each securing pin can therefore be independently locked in either the secured position or the assembly position.

Preferably the prop-head receiver is formed asymmetrical, so that the prop can swivel through a greater angle on one side. The asymmetry is relative to a plane which includes the longitudinal axis of the securing pin and is at right angles to a (main) swivel plane of the prop. On the other hand the prop-head receiver can be symmetrical relative to the (main) swivel plane of the prop.

An example embodiment of a prop-head bearing made in accordance with the invention will be described in further detail with reference to the accompanying drawings, in which.

Figure 1:
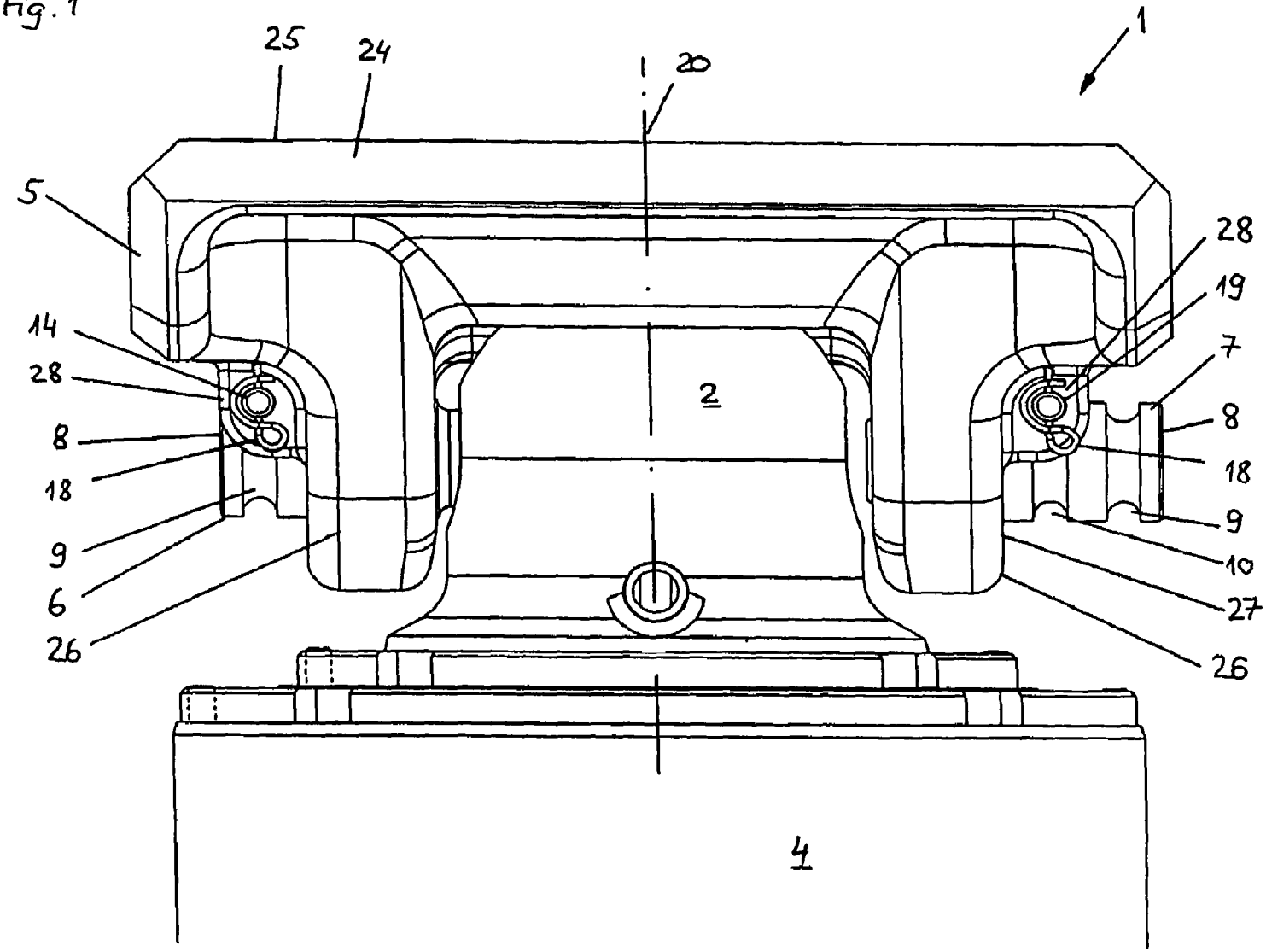
FIG. 1 shows a side view of a prop-head bearing according to the invention.
Figure 2:
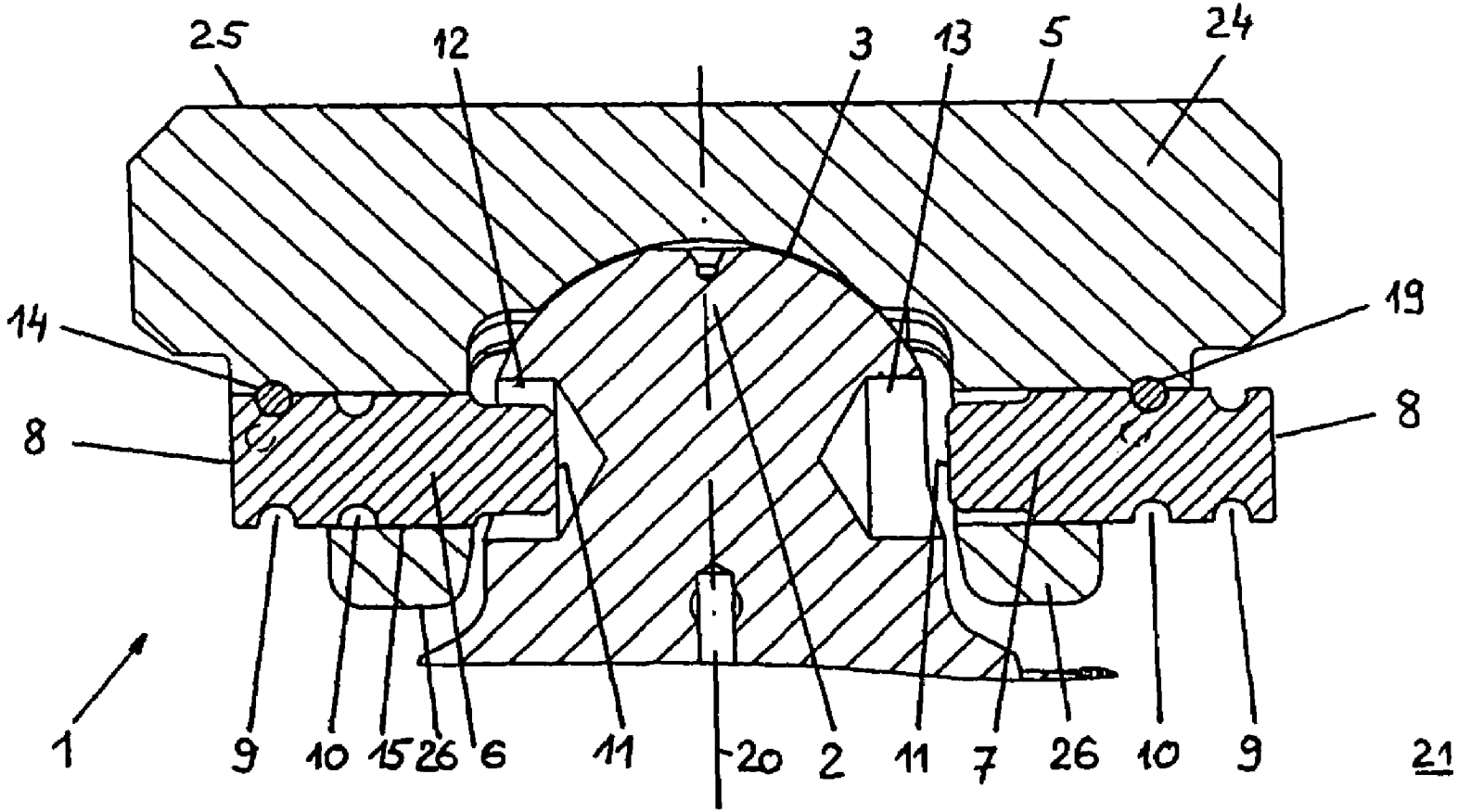
FIG. 2 shows a cross-sectional view of the prop-head bearing shown in FIG. 1.
Figure 3:
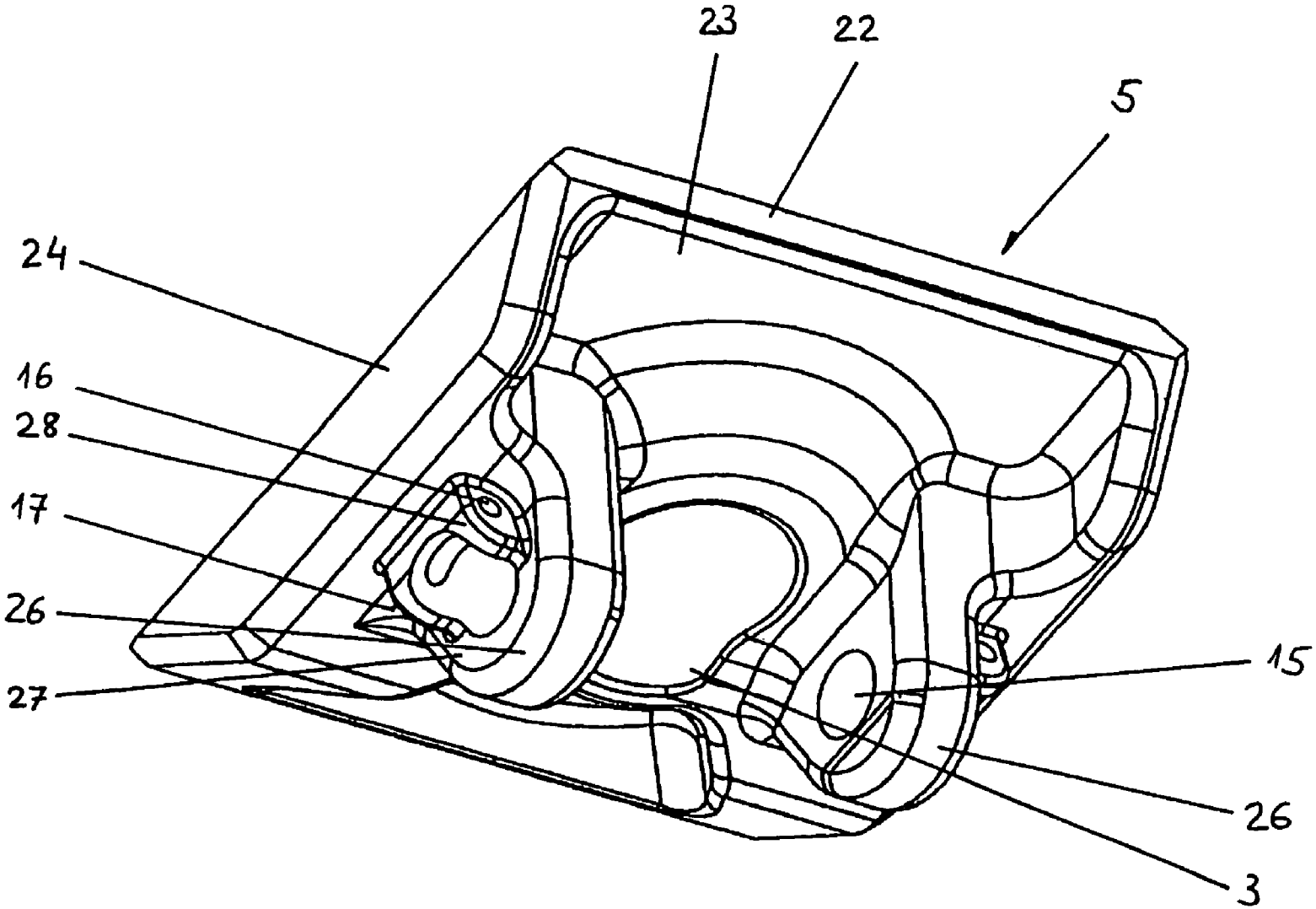
FIG. 3 shows a perspective view from the roof bar side of a prop-head receiver.

FIGS. 1 and 2 show a prop-head bearing or articulated connection 1 between the roof bar and the prop of a shield-type support frame (not shown in further detail) for underground working, comprising a floor runner, a prop and roof bar. As shown especially by the cross-sectional view in FIG. 2, the articulated connection 1 substantially comprises a joint head 2 on the prop and a prop-head receiver 5 on the roof bar and with a socket 3 in which the prop head 2 is pivotably mounted. The joint head 2 constitutes the ball-joint end of a prop 4 shown only partly in FIG. 2. The socket 3 is a component of a prop-head receiver 5, shown in a perspective view in FIG. 3 and constructed in the form of a one-piece casting. The casting can be welded for example to the underside of a roof bar of a shield-type support frame, so that the prop-head receiver 5, via the socket 3 formed therein, and the joint head 2 of the prop 4 can form an articulated connection between the roof bar and the prop.

To prevent accidental release of the joint head 2 from the socket 3, two securing pins are provided. The securing pin on the left side of FIGS. 1 and 2 is marked 6 and the pin on the right side is marked 7. The securing pins 6 and 7 are identical in construction and each has two slots 9 and 10, one at the end 8 remote from the joint head 2 and the other near the said end 8, the grooves being formed on the surface and extending in the peripheral direction of the securing pins 6, 7. The two grooves 9, 10 run all round the periphery of the securing pins 6, 7. The cross-sections of the grooves 9, 10 are semicircular. The grooves 9, 10 run parallel to one another, the groove 9 being more distant than the groove 10 from an end 11 of the securing pin facing the joint head.

Each securing pin 6, 7 is mounted in a bearing block 26 so as to be movable in the prop-head receiver 5. The longitudinal axes of the securing pins 6, 7 coincide with the (main) swivel axis of the prop 4. As can be seen especially from FIG. 2, the end 11 of the securing pin 6 facing the joint head 2 engages in a recess 12 in the joint head 2, whereas in the assembly position shown in FIGS. 1 and 2 the end 11 of the securing pin 7 does not project into a recess 13 in the joint head 2. Both recesses 12, 13 are in the form of blind bores.

When the shield-type support frame is in use, both securing pins 6, 7 occupy the position taken by the securing pin 6 in FIGS. 1 and 2. This position is the secured position, in which the joint head 2 is securely held in the socket 3. The position of the securing pin 7 in FIGS. 1 and 2 is an assembly position. When both securing pins 6, 7 are in this position, the joint head 2 can be taken out of the socket 3.

The securing pin 6 is locked by a locking bolt 14 which for this purpose lies in the semicircular groove 9 and prevents the securing pin 6 being shifted in either axial direction thereof. Since the securing pin 6 extends through an eyelet 15 in the bearing block 26 of the prop-head receiver 5, the diameter of the eyelet being substantially equal to the diameter of the securing pin 6, the securing pin 6 is completely secured in position. The locking bolt 14, as shown also in FIG. 3, extends through two spaced-apart aligned bearing eyelets 16, 17 and is itself secured by spring clips 18 against axial displacement (see FIG. 1).

A locking bolt 19 similarly fixes the position of the securing pin 7. By contrast with the securing pin 6, the locking bolt 19 for the securing pin 7 lies in the inner groove 10, since the securing pin 7, when in the assembly position, does not engage in the recess 13 in the joint head 2. The length of the shift between the assembly position and the securing position of the pins 6, 7 is determined by the spacing between the two grooves 9 and 10. The locking bolt 19 is also fixed by spring clips 18, so that axial displacement of the locking bolt 19 is impossible.

The prop-head receiver 5 is constructed with mirror symmetry in a plane 20 at right angles to the axes of the securing pins 6, 7, but the prop-head receiver 5 is asymmetrical in a plane 21 at right angles to the plane 20. The plane 21 corresponds to the plane of the drawing in FIG. 2, containing the longitudinal axes of the two securing pins 6 and 7. Owing to the asymmetry, the prop 4 can lean further in one direction in its swivel plane (corresponding to the plane 20) without colliding with the prop-head receiver 5, which to this end has a greater indentation 23 on one side 22 allowing the prop to slope correspondingly more on this side.

The prop-head receiver 5, in the form of a casting, comprises a solid substantially rectangular baseplate 24 with a flat base 25. The socket 3 is integrally moulded in the baseplate 24. The two opposite bearing blocks 26, each comprising the previously-described eyelet 15 for receiving one of the pins 6 and 7, are spaced apart and extend from the baseplate 24. The spacing between the two bearing blocks 26 is formed such that the joint head 2 can easily be inserted between them.

Bearings 28 for the locking bolts 14, 19 respectively are provided on the side remote from the joint head 2 or on an outer side 27 of a bearing block 26. The bearings 28 comprise two coaxially aligned eyelets 16 and 17, through which the locking bolts 14, 19 are inserted.

The invention claimed is:

1. A prop head bearing between the roof bar and the prop of a shield-type support frame, comprising a ball-joint socket on the roof bar and open towards the prop for receiving a ball-joint head on the prop, with at least one movable securing element which, when in a secured position, engages in a recess in the joint head to prevent accidental lifting of the joint head out of the socket, and with a bolt which locks the securing element in the secured position, in which that the securing element is in the form of a securing pin movable along its longitudinal axis between the secured position and an assembly position, wherein the securing pin is lockable by the bolt in the assembly position, in which it does not engage in the recess in the joint head.

2. A prop head bearing according to claim 1, in which the securing pin has at least two axially spaced-apart contact surfaces for the bolt.

3. A prop head bearing according to claim 1, in which the bolt locks the securing pin in both axial directions of the securing pin, both in the secured position and in the assembly position.

4. A prop head bearing according to claim 1, in which the securing pin, at an end (8) remote from the joint head, has at least two grooves on the periphery, extending in the peripheral direction.

5. A prop head bearing according to claim 4, in which the cross-section of a groove is semicircular.

6. A prop head bearing according to claim 1, in which the bolt is a locking bolt with a round cross-section.

7. A prop head bearing according to claim 1, in which the recess in the joint head is a blind bore.

8. A prop head bearing according to claim 1, in which the socket is formed in a prop-head receiver which comprises a bearing for the movable securing pin and a bolt bearing for the bolt.

9. A prop-head bearing according to claim 8, in which the prop-head receiver is formed in one piece.

10. A prop-head bearing according to claim 9, in which the prop-head receiver is in the form of a casting.

11. A prop head bearing according to claim 8, in which the socket is disposed between two opposite bearings for respective securing pins.

12. A prop head bearing according to claim 11, in which each bearing for the securing pin is associated with a bolt bearing.

13. A prop head bearing according to claim 8, in which the prop-head receiver is made asymmetrical relative to a plane at right angles to a main swivel plane of the prop, so that the joint head of the prop can swivel in the socket through a greater angle on one side.

14. A prop head bearing according to claim 1, in which on each side of the socket the prop-head receiver has a bearing block formed with an eyelet in which a respective securing bolt is mounted so as to be axially movable.

* * * * *